US011319806B2

(12) United States Patent
Jackson et al.

(10) Patent No.: US 11,319,806 B2
(45) Date of Patent: May 3, 2022

(54) SUBMERSIBLE DEVICE FOR MEASURING DRILLING FLUID PROPERTIES

(71) Applicant: HALLIBURTON ENERGY SERVICES, INC., Houston, TX (US)

(72) Inventors: Brice Aaron Jackson, Houston, TX (US); Daniel R. Robichaud, Humble, TX (US); Andrew Vos, Spring, TX (US); Lawrence Joseph Herskowitz, Pearland, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 310 days.

(21) Appl. No.: 16/605,161

(22) PCT Filed: Dec. 5, 2018

(86) PCT No.: PCT/US2018/064085

§ 371 (c)(1),
(2) Date: Oct. 14, 2019

(87) PCT Pub. No.: WO2020/117231

PCT Pub. Date: Jun. 11, 2020

(65) Prior Publication Data

US 2021/0381369 A1 Dec. 9, 2021

(51) Int. Cl.
*E21B 47/12* (2012.01)
*E21B 21/08* (2006.01)

(52) U.S. Cl.
CPC ..... *E21B 47/138* (2020.05); *E21B 21/08* (2013.01)

(58) Field of Classification Search
CPC ..... E21B 47/138; E21B 21/08
See application file for complete search history.

(56) References Cited

U.S. PATENT DOCUMENTS

| | | | | |
|---|---|---|---|---|
| 6,324,904 | B1 | 12/2001 | Ishikawa et al. | |
| 7,770,463 | B2 | 8/2010 | Sheverev et al. | |
| 8,201,461 | B2 | 6/2012 | Ronen et al. | |
| 9,664,553 | B1 | 5/2017 | Smith | |
| 10,653,027 | B2 * | 5/2020 | van Pol | E21B 47/117 |
| 10,968,734 | B2 * | 4/2021 | Jacob | E21B 47/10 |
| 2002/0185273 | A1 | 12/2002 | Aronstam et al. | |

(Continued)

FOREIGN PATENT DOCUMENTS

WO 2016176643 11/2016

OTHER PUBLICATIONS

International Search Report and Written Opinion dated Aug. 23, 2019, issued in corresponding PCT Application No. PCT/US2018/064085.

*Primary Examiner* — Shane Bomar
(74) *Attorney, Agent, or Firm* — McAfee & Taft

(57) ABSTRACT

Apparatuses and methods measuring properties of drilling fluids in which the drilling fluid is contained in a structure, and a measuring device and a processor are used to measure the properties. The measuring device is immersed within the drilling fluid. The measuring device can comprise a shell defining a chamber, a weight adapted to cause the measuring device to sink through the drilling fluid, a transmitter and at least one sensor adapted to measure a property of the drilling fluid. The transmitter is adapted to transmit data representing the property to the processor.

17 Claims, 6 Drawing Sheets

(56) References Cited

U.S. PATENT DOCUMENTS

| | | | | |
|---|---|---|---|---|
| 2008/0041173 | A1* | 2/2008 | Tormoen | F16L 55/48 73/866.5 |
| 2013/0118733 | A1* | 5/2013 | Kumar | E21B 41/0085 166/254.2 |
| 2013/0186645 | A1* | 7/2013 | Hall | E21B 23/00 166/382 |
| 2014/0172305 | A1* | 6/2014 | Jamison | E21B 49/005 702/9 |
| 2014/0367122 | A1* | 12/2014 | Murphree | E21B 33/12 166/386 |
| 2015/0212061 | A1 | 7/2015 | Radjy | |
| 2016/0258282 | A1* | 9/2016 | McClung, III | E21B 47/09 |
| 2016/0320769 | A1* | 11/2016 | Deffenbaugh | E21B 47/26 |
| 2018/0058179 | A1 | 3/2018 | Nuryaningsih et al. | |
| 2018/0262127 | A1 | 9/2018 | Gooneratne et al. | |
| 2020/0131890 | A1* | 4/2020 | Gooneratne | E21B 47/13 |
| 2020/0165905 | A1* | 5/2020 | Gooneratne | H02N 1/04 |

* cited by examiner

SUBMERSIBLE DEVICE FOR MEASURING DRILLING FLUID PROPERTIES

FIELD

The present disclosure relates generally to the field of drilling fluid used in oil and gas wells, and more specifically, to systems and methods of measuring properties of the drilling fluid.

BACKGROUND

Drilling fluid or mud are terms that encompass most fluids used in hydrocarbon drilling operations, especially fluids that contain significant amounts of suspended solids, emulsified water or oil. Drilling fluids can include water-based, oil-based and synthetic-based fluids.

In use, drilling fluid must be chosen or configured to meet the conditions of the well and subsurface formation. Such conditions include the well's design, anticipated formation pressures and rock mechanics, formation chemistry, the need to limit damage to the producing formation and temperature. To meet these conditions, drilling fluids offer a complex array of interrelated properties. These properties, which are usually defined by the well program and monitored during drilling, include rheology, density, fluid loss, solids content and chemical properties. Properties of the drilling fluid are determined by its composition and, for a specific drilling fluid composition may, to some extent, be manipulated using additives.

In the past, monitoring of the properties was problematic. Typically, such monitoring required sampling of the drilling fluid or placing probes into various positions within a retention pit containing the drilling fluid. Unfortunately, the properties can vary depending on the portion of drilling fluid sampled. For example, solids content can vary depending on the height at which a sample is taken; that is, samples taken from higher in the retention pit can have less of a solids content than samples taken from lower in the retention pit. This can be due to settling of suspended solids—typically called "sag". Additionally, other properties can vary in the retention pit; for example, temperature and pressure can vary depending on position in the retention pit and can affect many of the drilling fluid properties.

Also, once the drilling fluid is introduced downhole, there are even greater problems with determining the properties of the drilling fluid because probes cannot be as readily introduced into the drilling fluid and samples cannot readily be taken from various downhole positons.

Accordingly, better methods and systems for determining drilling fluid properties are needed.

BRIEF DESCRIPTION OF THE DRAWINGS

The drawings included with this application illustrate certain aspects of the embodiments described herein. However, the drawings should not be viewed as exclusive embodiments. The subject matter disclosed herein is capable of considerable modifications, alterations, combinations, and equivalents in form and function, as will be evident to those skilled in the art with the benefit of this disclosure.

DETAILED DESCRIPTION

Figure 1:
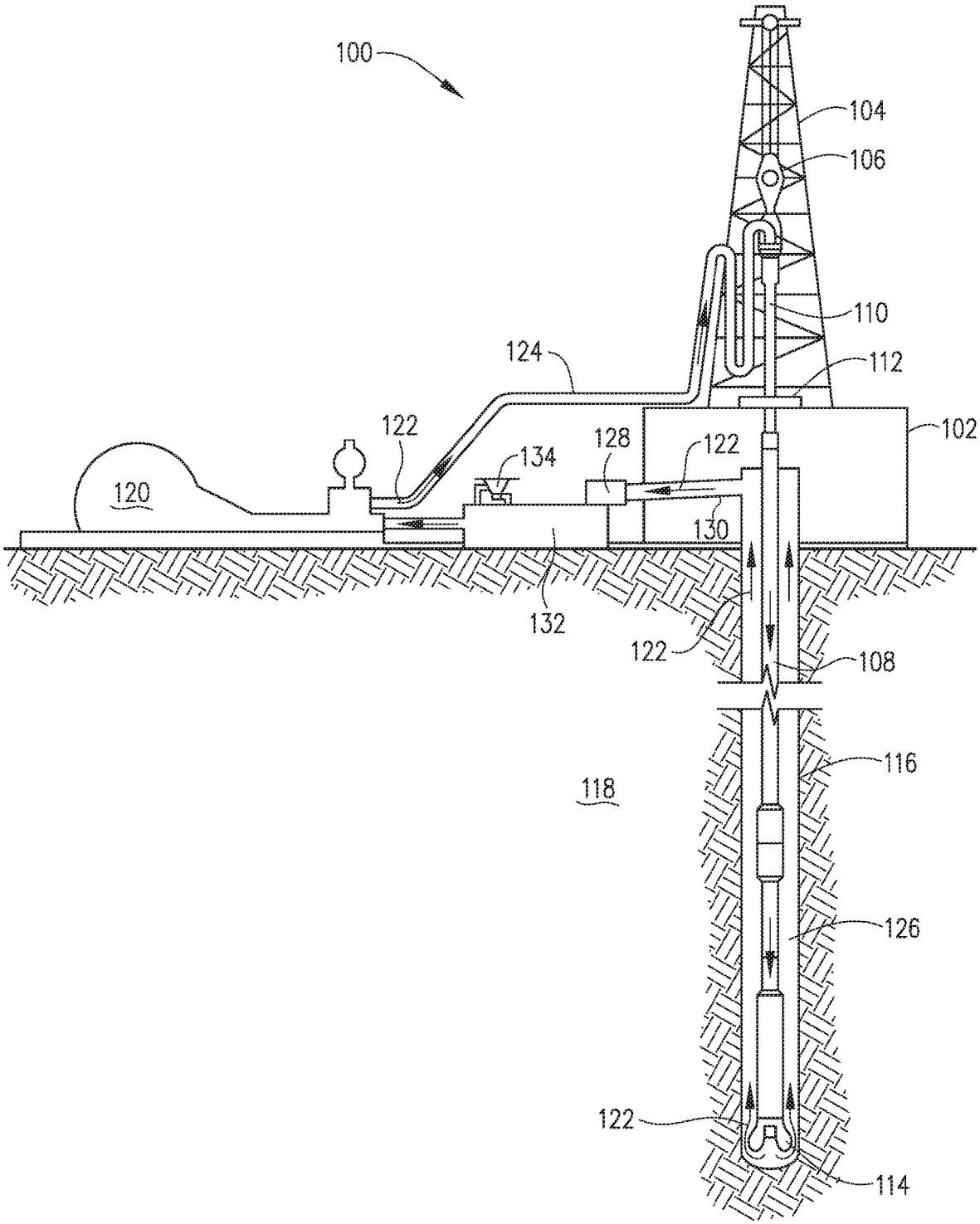
FIG. 1 is a schematic illustration of a land-based drilling assembly.

The present disclosure may be understood more readily by reference to this detailed description, including the figures. For simplicity and clarity of illustration, where appropriate, reference numerals may be repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may have been exaggerated to better illustrate details and features of the present disclosure.

The exemplary systems and processes for measuring drilling fluid properties disclosed herein are related to one or more components or pieces of equipment associated with the preparation, delivery, recapture, recycling, reuse, and/or disposal of drilling fluid. For example, and with reference to FIG. 1, the disclosed systems and processes may be used with one or more components or pieces of equipment associated with an exemplary wellbore drilling assembly 100, according to one or more embodiments. It should be noted that while FIG. 1 generally depicts a land-based drilling assembly, those skilled in the art will readily recognize that the principles described herein are equally applicable to subsea drilling operations, which employ floating or sea-based platforms and rigs, without departing from the scope of the disclosure.

As illustrated, the drilling assembly 100 may include a drilling platform 102 that supports a derrick 104 having a traveling block 106 for raising and lowering a drill string 108. The drill string 108 may include, but is not limited to, drill pipe and coiled tubing, as generally known to those skilled in the art. A Kelly 110 supports the drill string 108 as it is lowered through a rotary table 112. A drill bit 114 is attached to the distal end of the drill string 108 and is driven either by a downhole motor and/or via rotation of the drill string 108 from the well surface. As the drill bit 114 rotates, it creates a borehole 116 that penetrates various subterranean formations 118.

A pump 120 (e.g., a mud pump) circulates drilling fluid 122 through a feed pipe 124 and to the Kelly 110, which conveys the drilling fluid 122 downhole through the interior of the drill string 108 and through one or more orifices in the drill bit 114. The drilling fluid 122 is then circulated back to the surface via an annulus 126 defined between the drill string 108 and the walls of the borehole 116. At the surface, the recirculated or spent drilling fluid 122 exits the annulus 126 and may be conveyed to one or more fluid processing unit(s) 128 via an interconnecting flow line 130. After passing through the fluid processing unit(s) 128, a "cleaned" drilling fluid 122 is deposited into a nearby retention pit 132 (i.e., a mud pit). While illustrated as being arranged at the outlet of the borehole 116 via the annulus 126, those skilled in the art will readily appreciate that the fluid processing unit(s) 128 may be arranged at any other location in the drilling assembly 100 to facilitate its proper function, without departing from the scope of the disclosure.

One or more chemicals or additives may be added to the drilling fluid 122 via a mixing hopper 134 communicably coupled to or otherwise in fluid communication with the retention pit 132. The mixing hopper 134 may include, but is not limited to, mixers and related mixing equipment known to those skilled in the art. However, the chemicals or additives may be added to the drilling fluid 122 at any other location in the drilling assembly 100. In at least one embodiment, for example, there could be more than one retention pit 132, such as multiple retention pits 132 in series. Moreover, the retention pit 132 may be representative of one or more fluid storage facilities and/or units.

While not specifically illustrated herein, the disclosed system and methods can also be used to measure properties of drilling fluids in transport or delivery equipment used to convey the drilling fluid to the drilling assembly 100 such as, for example, any transport vessels, conduits, pipelines, trucks, tubulars, and/or pipes used to fluidically move the drilling fluid from one location to another.

As indicated above, the exemplary systems and process for measuring drilling fluid properties generally will make measurements aimed at determining the properties, including but not limited to rheology, density, fluid loss, solids content and chemical properties. To determine such properties, or other properties, of the drilling fluid, the systems and process can measure a variety of drilling fluid conditions, such as temperature, pH, pressure, viscosity, sag, electrical properties, density, etc.

As used herein, "sag" refers to the settling of particles in the drilling fluid, which can occur in the retention pit, in the annulus of a well, or elsewhere, when the drilling fluid is static or being circulated. Because of the combination of secondary flow and gravitational forces, weighting materials can settle in a flowing drilling fluid. Accordingly, weighted materials or other solids may be more concentrated lower in the drilling fluid than higher in the drilling fluid. If settling is prolonged, the upper part of the mud—such as in the upper part of a wellbore—decreased density, which can result in issues in the well. For example, the decreased density can lessen the hydrostatic pressure in the hole, so an influx (a kick) of formation fluid can enter the well.

Proper determination of the drilling fluid properties is important for a variety of reasons. For example, as indicated above, sag can be important to avoid kicks and other operational issues. Additionally, determination of the rheology is generally important because a high viscosity fluid is desirable to carry cuttings to surface and suspend weighting agents in the drilling fluid. However, if viscosity is too high, friction may impede the circulation of the mud causing excessive pump pressure, decrease the drilling rate, and hamper the solids removal equipment. The flow regime of the drilling fluid in the annulus is also affected by viscosity.

Also by way of example but not limitation, determination of the density of the drilling fluid can be helpful to ensure sufficient hydrostatic pressure is maintained to prevent the borehole wall from caving in and to keep formation fluid from entering the wellbore. Additionally, as a further example, the higher the density of the drilling fluid compared to the density of the cuttings, the easier it is to clean the hole—the cuttings will be less inclined to fall through the mud. If the drilling fluid density is too high, rate of drilling decreases and the chances of differential sticking and accidentally fracturing the well increase as does the drilling fluid cost.

By way of further example, chemical properties of the drilling fluid are central to performance and hole stability. Properties such as pH can affect the performance of polymers in the drilling fluid and corrosion in the well.

Figure 2:
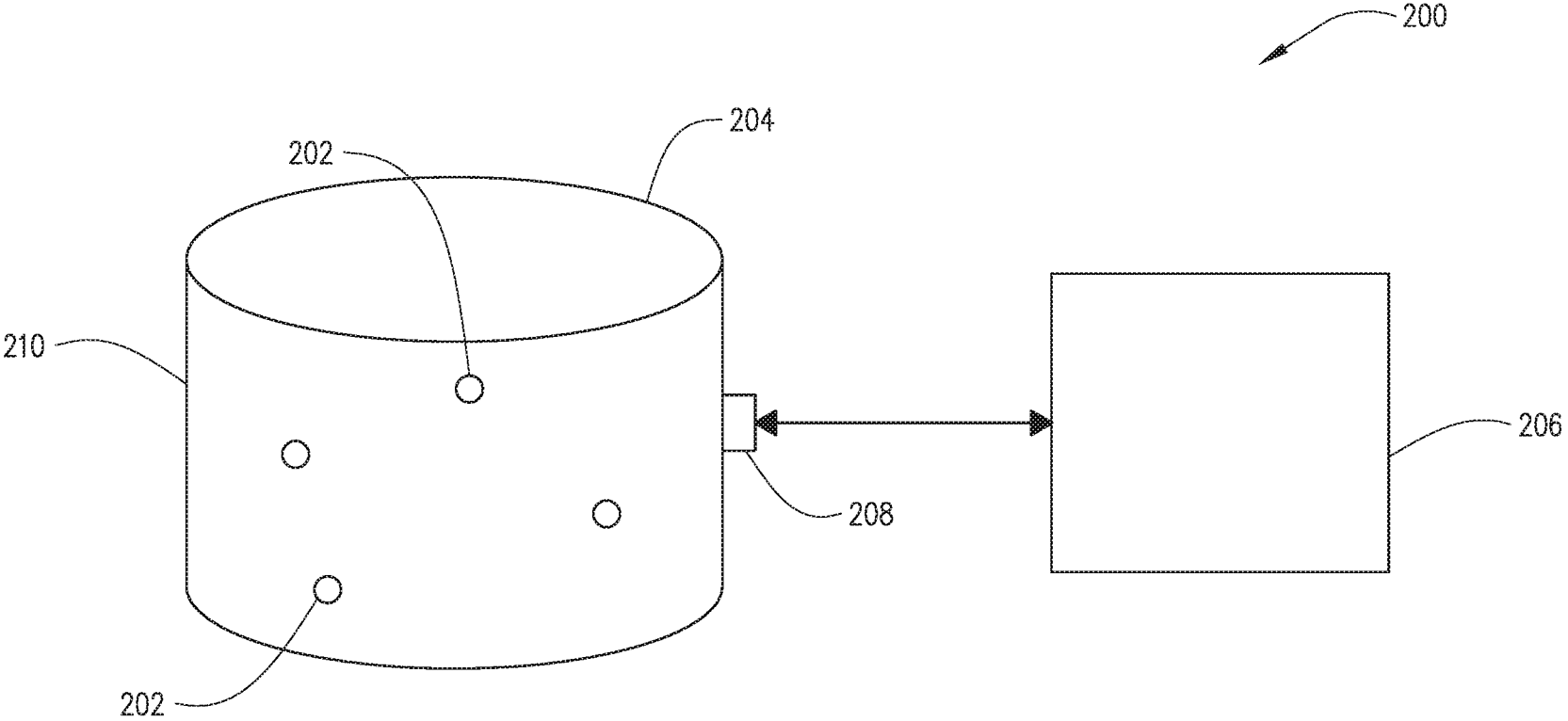
FIG. 2 is a schematic illustration of a system for measuring drilling fluid properties.

In accordance with some embodiments of this disclosure, a system 200 for measuring drilling fluid properties is illustrated in FIG. 2. The system 200 comprises one or more measuring devices 202, which are immersed in a drilling fluid 210 contained in a structure 204, such as in a retention pit, a pipeline, a cargo hold of a vessel, or within a borehole. The measuring device transmits data on drilling fluid properties to a processor 206. The processor 206 can be a typical computer with data storage, processing, input/output devices, etc. The processor is configured to receive the data and/or to calculate at least one characteristic of the drilling fluid based on the data received. For example, the characteristic can include viscosity, density, sag and the like. Calculation of the characteristics can include one or a combination of multiple measurements from one or multiple devices.

Typically, measuring devices 202 will send a signal, which can be directly or indirectly received by processor 206. For example, as shown in FIG. 2, a receiver/transmitter 208 can be mounted on or adjacent to the structure 204, and the signal from measuring device 202 relayed by receiver/transmitter 208 to processor 206. Similarly, the receiver/transmitter can be located near a borehole where the measuring device is being used, or near any other structure which contains drilling fluid in which the measuring device is immersed.

The processor can be remote or near to the drilling fluid operations. For example, the receiver/transmitter can be a mobile device which receives the data signal from the measuring device and relays the data wirelessly, through a cellular network, or through a wired network to the processor.

Figure 4:
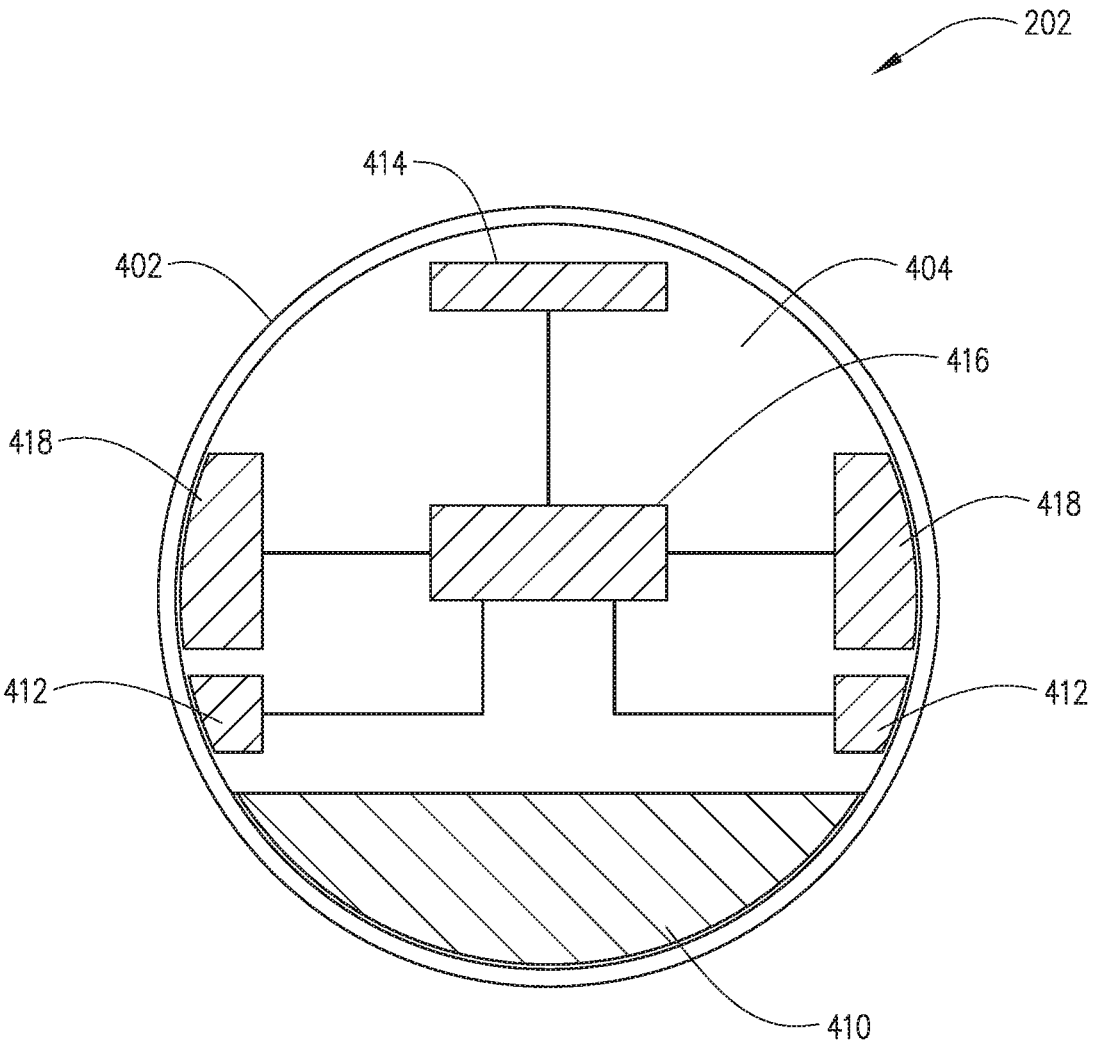
FIG. 4 is a cross-sectional view of one embodiment of a measuring device in accordance with certain embodiments.

As shown in FIG. 4, measuring device 202 can comprise a shell 402. The shell 402 can be made of any suitable material which can survive immersion in the drilling fluid. For example, shell 402 can be made of steel, stainless steel, titanium, aluminum, plastic resin or combinations thereof. Generally, the measuring device 202 will be any suitable size, typically about 1 cubic inch to 1000 cubic inches. While shell 402 is illustrated as being spherical in shape, it can have any suitable shape based on the conditions. For example, shell 402 can have a shape selected from egg-shaped or ovoid, spherical, plumb-bob shaped, cylinder, rounded cylinder, cone, rounded cone and parachute-shaped. FIGS. 6-10 illustrate the cylinder, rounded cylinder, cone, rounded cone and parachute-shaped shells, respectively. Any of the shapes of shell 402 can include extrusions or indentations to help in producing reliable measurements.

Shell 402 might be ovoid to facilitate movement through the fluid by a locomotive, as described below, or might have a plumb-bob shape, cylinder, rounded cylinder, cone or rounded cone to maintain a specific orientation as it sinks through the drilling fluid. Naturally, any of the shapes can be weighted more at one end than the other to help maintain orientation. For example, a rounded-cylinder shape should be stable while sinking in the viscous liquid to maintain an upright or longitudinal orientation, i.e. the longitudinal axis of the cylinder is maintained vertically oriented. Further, the rounded-cylinder shape can be weighted at its lower end so as to help maintain the upright orientation. A cylinder, having flat ends, provides for the measuring device to rotate about its long axis while it sinks. This rotation can be correlated to the viscosity of the liquid to aid in viscosity measurements. The cone or rounded cone provides for a hydrodynamic shape with reduced hydrodynamic drag. The parachute like geometry can reduce the rate of sinking while providing for a stable orientation. Using a plurality of measuring devices having different shapes provides for the measuring devices to drop and at different speeds with the resulting measurements provide differences in characteristics near the surface and at subsequent levels below so as to better understand the characteristics of the fluid at different levels.

Other shapes can also be useful. For example, a spikey ball configuration—i.e. a spheroid with projections—could be used to measure internal currents in fluid. Fins or a spiral ramp on the surface of the shell can be used to cause rotation which would aid in measurements for viscosity. Holes or tunnels extending from one side of the shell through the measuring device to the other side of the shell can be used for stability of the measuring device use. Further, a large hole through the measuring device (center or off center) can be used as a testing area. Liquid that would flow through this area would be subjected to measurements of its properties. A mesh or filter at the opening at the surface of the shell can be used to help prevent fouling. Alternatively, measurements can also be done outside of the object. For example, measurements can be done in the liquid passing along the surface of the shell or done in eddies around the object or in the wake turbulence or created vortices. Eddies can occur, for example, in the parachute design directly behind the measuring device as it falls through the drilling fluid, or in small sections close to the object surface. For example, in the device described below and illustrated in FIG. 5, fluid passing through channel 430 can be sampled or measured by the sensors within the device.

Figure 3:
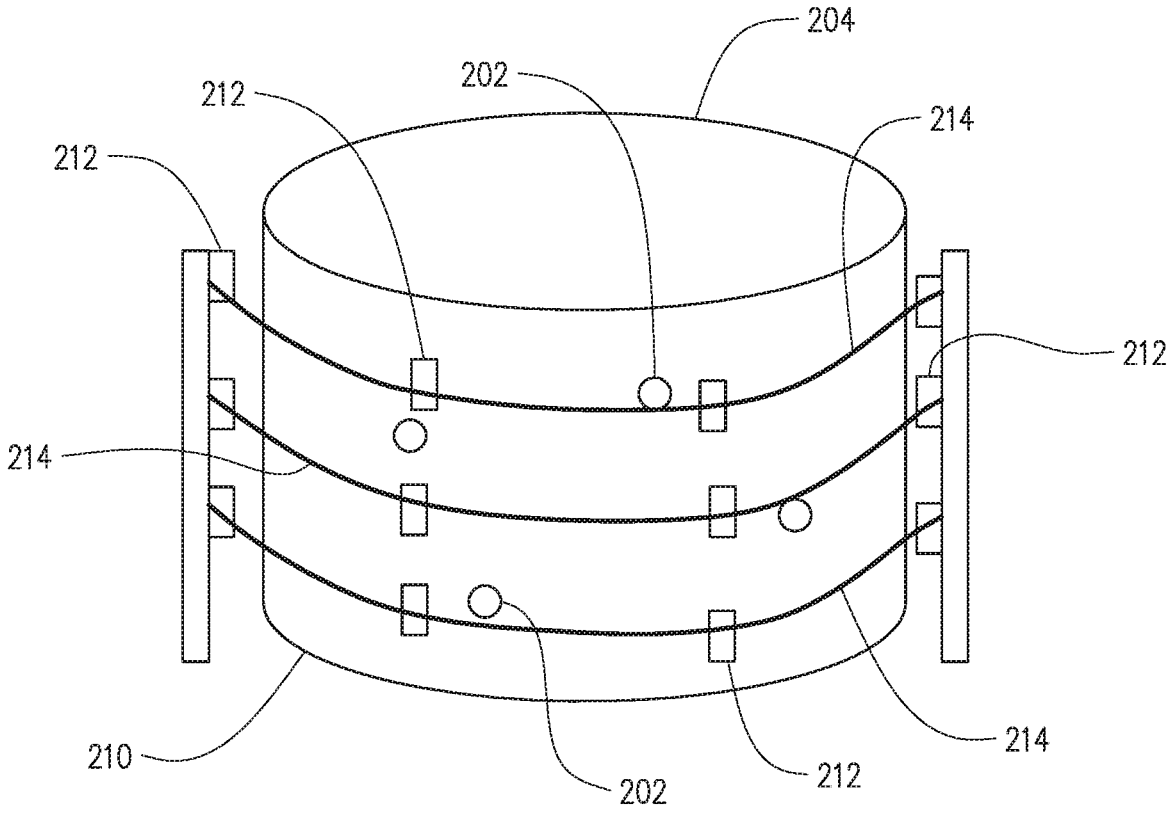
FIG. 3 is a schematic illustration of a structure containing drilling fluid and including a locomotive for moving measurement devices within the drilling fluid.

Shell 402 defines chamber 404, which can include a weight 410 adapted to cause the measuring device to sink through the drilling fluid. The weight can also be configured to maintain a predetermined orientation of the measuring device within the drilling fluid. When one measuring device is employed, it is typically desirable for weight 410 to be sufficient to cause the measuring device to sink to the bottom of structure 204. However, some embodiments using a plurality of measuring devices 202 will have the weights vary among the measuring devices; thus, some devices may sink, some devices can be buoyant to float on the surface of the drilling fluid, and some devices can float within the drilling fluid at predetermined locations by having neutral buoyancy. Thus, the measuring devices 202 will sink at different rates through the drilling fluid and/or to different heights in the drilling fluid depending on the viscosity and density of the drilling fluid and the resulting buoyancy effect on the measuring devices. Thus, as illustrated in FIGS. 2 and 3, the measuring devices are at different heights in the drilling fluid.

Also, a plurality of the measuring devices 202 can be used so that each of the measuring devices can be configured to measure one or more properties of the drilling fluid. The properties measured can be different from the other measuring devices or can be the same properties as measured by the other measuring devices. The shape of shell 402 for each measuring device 202 can be configured to facilitate the measurement of the property.

Returning now to FIG. 4, chamber 404 will typically contain at least one sensor 412 adapted to measure a property of the drilling fluid. For example, a sensor can be an accelerometer to measure force and velocity, a gyroscope to measure rotation, a GPS sensor to measure location, a pressure sensor, a temperature sensor or a pH probe.

Generally, the sensor(s) can be configured to measure one or more properties. In some embodiments, at least one of the properties is selected from location, acceleration, velocity, temperature, pressure and electrical properties. Generally, the location is the location of the measuring device in the drilling fluid at a particular time, the acceleration is the acceleration of the measuring device through the drilling fluid at a particular time, and the velocity is the velocity of the measuring device through the fluid at a particular time. Typically, the temperature, pressure and electrical properties measured will be those of the drilling fluid surrounding the measuring device at a particular time. From a single property or a combination of multiple properties, characteristics such as density, viscosity, etc. can be determined about the drilling fluid; for example, viscosity might be determined from velocity and/or acceleration of the device through the drilling fluid. Additionally, the properties can be determined for the drilling fluid at predetermined locations in the structure and at predetermined times. Thus, variations of the properties across the drilling fluid and across time can be determined.

Chamber 404 can further include a transmitter 414 connected to the sensor 412 for transmitting data from the sensor, a power and processing unit 416 connected to sensor 412 and transmitter 414. In some embodiments, the transmitter 414 is also a receiver so as to receive signals providing instructions to the measuring device. Power and processing unit 416 can include a power source to provide power to the sensor(s) 412 and transmitter 414. Further, power and processing unit 416 can include a processor to process instructions and signals received from the transmitter and to control the sensors and transmitter. Additionally, the power and processing unit 416 can include a memory device for recording measurements.

In some embodiments, there will also be a locomotive 418, which can be any suitable means by which measuring device 202 can be moved through drilling fluid in the structure. Locomotive 418 can be powered and controlled by power and processing unit 416 or have its own power source and/or processing unit.

For example, locomotive 418 can be a mini gas cartridge, which can be activated to expel gas thus decreasing the density of the measuring device and changing its buoyancy. Alternatively, the locomotive 418 can be a pressure exchange system having chambers which can be filled or emptied with drilling fluid by activating the gas cartridges. In some embodiments, the gas cartridge can be used to propel the measuring device through the drilling fluid by the force of expelled gas, thus the measuring device can be propelled laterally through the liquid.

In another embodiment, locomotive 418 is a swim bladder which can be expanded to pull drilling fluid into the measuring device or collapsed to expel drilling fluid from the measuring device. In this manner, the measuring device density can be changed and/or the force of the expelled drilling fluid can be used to propel the measuring device through the fluid. In some embodiments, the measuring device will be neutrally point when empty of drilling fluid or is less dense than the drilling fluid, so that when drilling fluid introduced into a chamber or swim bladder, the measuring device will sink in the drilling fluid.

In another example, locomotive 418 can be a predetermined quantity of a ferrimagnetic material contained in the shell 402. In such case, the system can further include a plurality of magnetic devices 212 positioned around the structure as schematically illustrated in FIG. 3. Selective activation of magnetic devices 212 moves the measuring device through the drilling fluid to different locations within the structure. As illustrated, the magnetic devices 212 can be repositioned by moving them along rails 214 extending around the structure 204. Thus, movement of measuring devices 202 is activated by selectively turning on or off magnets, adjusting the strength of the magnets and/or moving the magnets about structure 204 on rails 214. However, in some embodiments, magnetic devices 212 are stationary and induce movement only by selectively turning on or off magnets and/or adjusting the strength of the magnets.

The ferrimagnetic material contained in shell 402 can be the shell itself or can be embedded in the inside surface of the shell. In some embodiments, the ferrimagnetic material will be weight 410; in others, it will be a separate component contained in chamber 404.

Figure 5:
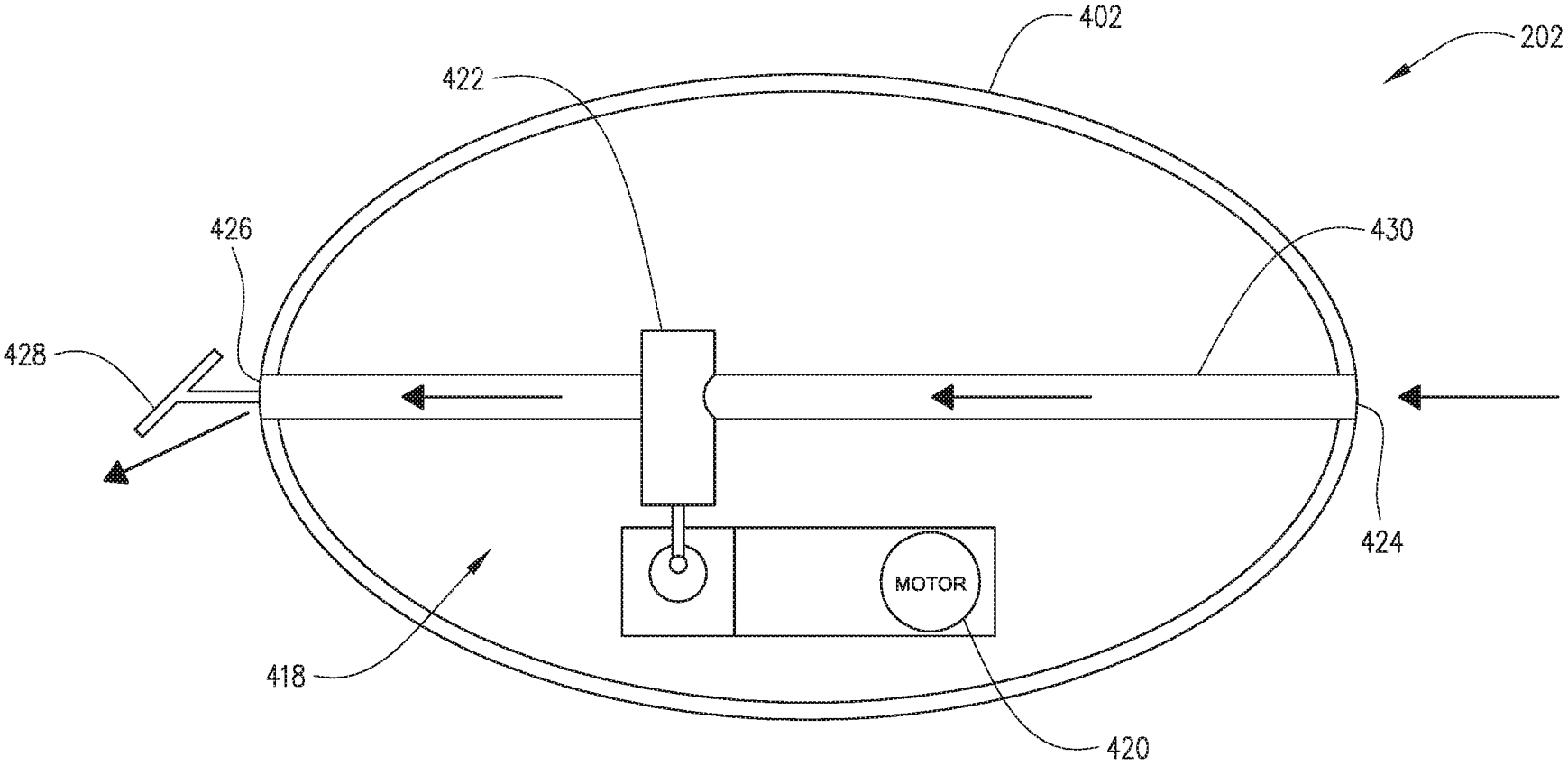
FIG. 5 is a cross-sectional view of one embodiment of a measuring device showing a locomotive in accordance with certain embodiments.
Figure 6:
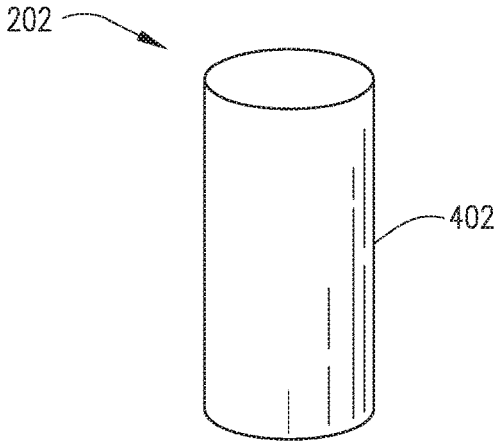
FIG. 6 is an illustration of a measuring device with a cylindrical shell.
Figure 7:
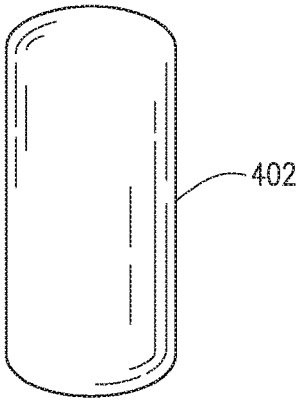
FIG. 7 is an illustration of a measuring device with a rounded cylindrical shell.
Figure 8:
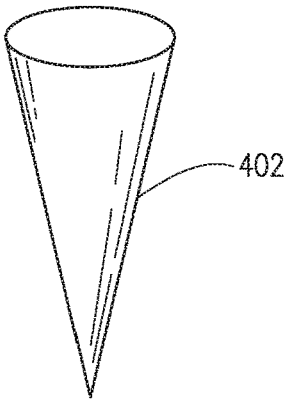
FIG. 8 is an illustration of a measuring device with a conical shell.
Figure 9:
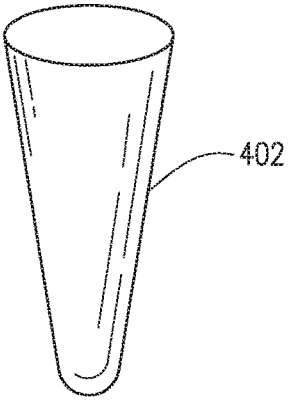
FIG. 9 is an illustration of a measuring device with rounded conical shell.
Figure 10:
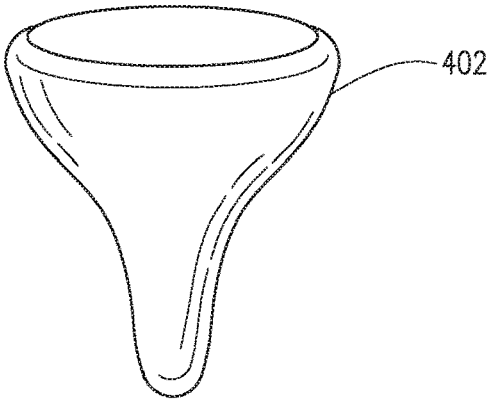
FIG. 10 is an illustration of a measuring device with a parachute-shaped shell.

In other embodiments, locomotive 418 can be a motorized system for moving measuring device 202 through drilling fluid. For example, locomotive 418 can be a motor internal to shell 402, which spins a propeller (not shown) external to shell 402. In another example, locomotive 418 can be a hydraulic propulsion system such as illustrated in FIG. 5, where a motor 420 activates a pump 422. Pump 422 draws in drilling fluid through an input port 424 in shell 402 and then forces the drilling fluid out through output port 426 in shell 402. A rudder 428 can be used to direct the drilling fluid coming out of port 426. The rudder can be controlled by a processor in the measuring device 202. In FIG. 5, the other components of measuring device 202 besides locomotive 418 are not illustrated for simplicity.

The above system, and other similar systems apparent from review of this disclosure, can be used to carry out a method for measuring drilling fluid properties. Under the method, one or more measuring devices are immersed into a drilling fluid such that said measuring device moves through the drilling fluid. In some embodiments, the measuring device will move by gravitational forces alone. In others, a locomotive system can be used to aid in guiding the movement and/or allow horizontal movement of the measuring device(s).

The drilling fluid can be contained in a structure such as a retention pit or storage vessel. However, in some applications of the method, the drilling fluid is in the borehole of the well such as during drilling operations or during temporary stops in drilling operations. In such applications, the measuring device can be introduced directly into the drilling fluid in the borehole; however, the measuring device can be introduced in the first retention pit and then be carried downhole with the drilling fluid as it is introduced from the retention pit into the borehole.

After immersion in the drilling fluid, the measuring device is used to detect a property of the drilling fluid. The detection is made by a sensor contained in the measuring device, which produces data. Typically, the detecting of the property occurs while the measuring device moves through the drilling fluid.

The data is received from the measuring device. Generally, the data is received by a processor as described above. A characteristic of the drilling fluid is determined based on the data received. In some embodiments, the characteristic includes at least one of viscosity, density and sag. In many applications, the detecting of the property occurs at multiple locations throughout the drilling fluid in the retention pit and/or at multiple locations throughout the borehole. Thus, the determining of the characteristic represents changes in the first property of the drilling fluid among the different locations and time.

In some embodiments, such as when the measuring devices are used in a borehole, it can be advantageous to store the measurements in power and processing unit 416 while the measuring devices are downhole and then to receive the data from the measuring device after recovery of the measuring device. For example, the measuring device can be introduced downhole with the drilling fluid through drill string 108 in FIG. 1. The measuring device takes measurements when downhole and is afterwards circulated back up hole through annulus 126. After the measuring device is recovered at the surface, the measurements are transmitted to processor 206 and used to calculate characteristics of the drilling fluid when it is downhole. The received properties and calculated characteristics can be used to make adjustments to the drilling fluid composition to improve downhole performance.

In many embodiments, the composition of the drilling fluid can be adjusted periodically or on an ongoing basis on the characteristic(s) determined for the drilling fluid, the conditions in the well (which can be determined from the data received from the measuring device or data obtained independently therefrom) and reference to a predetermined specification for drilling fluid composition based on the well conditions.

As is known to those skilled in the art, drilling fluid contains a variety of components at predetermined concentrations. For example, drilling fluid can be aqueous or oil based, and can contain the method further comprises clays, caustic soda, salts, emulsifiers, surfactants, viscosifiers, gelling agents, etc.

From the above disclosure, many embodiments will become apparent to those skilled in the art. For example, the above disclosure is exemplified by a system comprising a structure, a measuring device and a processor. The structure contains a drilling fluid. The measuring device is immersed within the drilling fluid. The measuring device comprises a shell defining a chamber. In some embodiments, the shell is a shape selected from egg-shaped or ovoid, spherical, plumb-bob shaped, cylinder, rounded cylinder, cone, rounded cone and parachute-shaped.

Within the chamber of the shell is a weight, at least one sensor and a transmitter. The weight is adapted to cause the measuring device to sink through the drilling fluid, wherein said weight is located in the chamber. The sensor is adapted to measure a property of the drilling fluid. The property includes at least one of location, acceleration, velocity, temperature, pressure and electrical properties. The transmitter is adapted to transmit data representing the property.

The processor is adapted to receive the data from the measuring device immersed in the drilling fluid. The processor is also configured to determine at least one characteristic of the drilling fluid based on the data received, wherein the characteristic includes at least one of viscosity, density and sag.

In some embodiments, the measuring device includes a locomotive. Some of the embodiments utilize a predetermined quantity of a ferrimagnetic material contained in the shell. The system includes a plurality of magnetic devices positioned around the structure such that selective activation of the magnetic devices moves the measuring device through the drilling fluid to different locations within the structure. In other of these embodiments, the locomotive includes a motor configured to propel the measuring devices through the drilling fluid to different locations within the structure.

In some embodiments of the system, there are a plurality of the measuring devices. Each of the measuring devices is configured to measure a property of the drilling fluid different from the other measuring devices. The shape of the shell for each measuring device is configured to facilitate the measurement of the property. The processor receives data relating to the property from each of the measuring devices so as to determine a plurality of characteristics of the drilling fluid. In some of these embodiments, at least a portion of the devices includes a locomotive such as described above.

Another exemplary set of embodiments are directed to a method comprising the steps of:

- immersing a measuring device into a drilling fluid such that said measuring device moves through the drilling fluid;
- detecting a first property of the drilling fluid by a sensor contained in the measuring device to produce first data, wherein the detecting of the first property occurs while the measuring device moves through the drilling fluid;
- receiving the first data from the measuring device; and
- determining a first characteristic of the drilling fluid based on the first data received, wherein the first characteristic includes at least one of viscosity, density and sag.

In some of the embodiments of the method, the detecting of the first property can occur at multiple locations throughout the drilling fluid so that the determining of the first characteristic represents changes in the first property of the drilling fluid among different locations.

In some embodiments, the methods above further include:

- introducing the drilling fluid containing the measuring device downhole into a well;
- detecting a second property of the drilling fluid by the sensor contained in the measuring device to produce second data, wherein the detecting of the second property occurs while the measuring device moves with the drilling fluid downhole;
- receiving the second data from the measuring device; and
- determining a second characteristic of the drilling fluid based on the second data received, wherein the second characteristic includes at least one of temperature, viscosity, density, sag and circulation of the drilling fluid downhole.

In these embodiments, the detecting of the second property can occur at multiple locations downhole so that the determining of the first characteristic represents changes in the first property of the drilling fluid among different locations downhole. Further, the detecting of the first property can occur in a structure used to contain the drilling fluid prior to introduction downhole.

Also, in the above methods, the drilling fluid can comprise a plurality of components at a concentration, and the method can further comprise adjusting the concentration of the components based on the first characteristic.

In any of the above methods, the measuring device can move through the drilling fluid by a locomotive configured to propel the measuring device through the drilling fluid. In some embodiments, the measuring device includes a predetermined quantity of a ferrimagnetic material contained in the shell. The locomotive includes a plurality of magnetic devices positioned around the structure such that selective activation of the magnetic devices moves the measuring device through the drilling fluid to different locations within the structure. In other of embodiments, the measuring device includes the locomotive, and the locomotive comprises a motor configured to propel the measuring devices through the drilling fluid to different locations within the structure.

Therefore, the present compositions and methods are well adapted to attain the ends and advantages mentioned, as well as those that are inherent therein. The particular examples disclosed above are illustrative only, as the present treatment additives and methods may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative examples disclosed above may be altered or modified, and all such variations are considered within the scope and spirit of the present treatment additives and methods. While compositions and methods are described in terms of "comprising," "containing," "having," or "including" various components or steps, the compositions and methods can also, in some examples, "consist essentially of" or "consist of" the various components and steps. Whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee.

What is claimed is:

1. A system comprising:

a structure containing a drilling fluid;

a measuring device immersed within the drilling fluid, the measuring device comprising:

a shell defining a chamber;

a weight adapted to cause the measuring device to sink through the drilling fluid, wherein said weight is located in the chamber;

at least one sensor adapted to measure a property of the drilling fluid, wherein the sensor is located in the chamber, and wherein the property includes at least one of location, acceleration, velocity, temperature, pressure and electrical properties;

a predetermined quantity of a ferrimagnetic material contained in the shell; and a transmitter adapted to transmit data representing the property; and a processor adapted to:

receive the data from the measuring device immersed in the drilling fluid; and determine at least one characteristic of the drilling fluid based on the data received, wherein the characteristic includes at least one of viscosity, density and sag; and a plurality of magnetic devices positioned around the structure such that selective activation of the magnetic devices moves the measuring device through the drilling fluid to different locations within the structure.

2. The system of claim 1, wherein the shell has a shape selected from egg-shaped or ovoid, spherical, plumb-bob shaped, cylinder, rounded cylinder, cone, rounded cone and parachute-shaped.

3. A system comprising, a structure containing a drilling fluid;

a plurality of measuring devices immersed within the drilling fluid, wherein each measuring device of the plurality of measuring devices comprises:

a shell defining a chamber;

a weight adapted to cause the measuring device to sink through the drilling fluid, wherein said weight is located in the chamber;

at least one sensor adapted to measure a property of the drilling fluid, wherein the sensor is located in the chamber, and wherein the property includes at least one of location, acceleration, velocity, temperature, pressure and electrical properties; and a transmitter adapted to transmit data representing the property; and a processor adapted to:

receive the data from the measuring device immersed in the drilling fluid; and determine at least one characteristic of the drilling fluid based on the data received, wherein the characteristic includes at least one of viscosity, density and sag; and wherein each of the measuring devices is configured to measure a property of the drilling fluid different from the other measuring devices, and the shape of the shell for each measuring device is configured to facilitate the measurement of the property, and wherein the processor receives data relating to the property from each of the measuring devices so as to determine a plurality of characteristics of the drilling fluid.

4. The system of claim 3, wherein at least a portion of the measuring devices include a predetermined quantity of a ferrimagnetic material contained in the shell, and wherein the system includes a plurality of magnetic devices positioned around the structure such that selective activation of the magnetic devices moves the portion of the measuring device through the drilling fluid to different locations within the structure.

5. The system of claim 3, wherein at least a portion of the measuring device include a motor configured to propel the portion of the measuring devices through the drilling fluid to different locations within the structure.

6. A method comprising:

immersing a measuring device into a drilling fluid in a structure such that said measuring device moves through the drilling fluid by a locomotive configured to propel the measuring device through the fluid, and wherein the measuring device includes a predetermined quantity of a ferrimagnetic material contained in the measuring device, and wherein the locomotive includes a plurality of magnetic devices positioned around the structure such that selective activation of the magnetic devices moves the measuring device through the drilling fluid to different locations within the structure;

detecting a first property of the drilling fluid by a sensor contained in the measuring device to produce first data, wherein the detecting of the first property occurs while the measuring device moves through the drilling fluid in the structure;

receiving the first data from the measuring device; and determining a first characteristic of the drilling fluid based on the first data received, wherein the first characteristic includes at least one of viscosity, density and sag, and wherein the detecting of the first property occurs at multiple locations throughout the drilling fluid so that the determining of the first characteristic represents changes in the first property of the drilling fluid among different locations.

7. The method of claim 6 further including:

introducing the drilling fluid containing the measuring device downhole into a well;

detecting a second property of the drilling fluid by the sensor contained in the measuring device to produce second data, wherein the detecting of the second property occurs while the measuring device moves with the drilling fluid downhole;

receiving the second data from the measuring device; and determining a second characteristic of the drilling fluid based on the second data received, wherein the second characteristic includes at least one of temperature, viscosity, density, sag and circulation of the drilling fluid downhole.

8. The method of claim 7, wherein the detecting of the second property occurs at multiple locations downhole so that the determining of the first characteristic represents changes in the first property of the drilling fluid among different locations downhole.

9. The method of claim 8, wherein the drilling fluid comprises a plurality of components at a concentration, and the method further comprises:

adjusting the concentration of the components based on the first characteristic.

10. The method of claim 9, wherein the measuring device includes the locomotive, and the locomotive comprises a motor configured to propel the measuring devices through the drilling fluid to different locations within the structure.

11. The method of claim 10, wherein the measuring device comprises an outer shell having a shape selected from egg-shaped or ovoid, spherical, plumb-bob shaped, cylinder, rounded cylinder, cone, rounded cone and parachute-shaped.

12. The method of claim 11, wherein there are a plurality of the measuring devices which together detect a plurality of first properties, and each of the measuring devices is configured so as to detect a different first property of the drilling fluid from the other measuring devices, and wherein the first data relates to the plurality of first properties so as to determine the first characteristic of the drilling fluid.

13. The method of claim 12, wherein when the drilling fluid is introduced downhole, the plurality of the measuring devices together detect a plurality of second properties, and wherein the second data relates to the plurality of second properties so as to determine the second characteristic of the drilling fluid.

14. The method of claim 13, wherein the shape of the shell is configured to facilitate the detecting of at least one of the first property and the second property.

15. A method comprising:

immersing a measuring device into a drilling fluid such that said measuring device moves through the drilling fluid;

detecting a first property of the drilling fluid by a sensor contained in the measuring device, wherein the detecting of the first property occurs while the measuring device moves through the drilling fluid, and wherein there are a plurality of the measuring devices which together detect a plurality of first properties, and each of the measuring devices is configured so as to detect a different first property of the drilling fluid from the other measuring devices to produce first data related to the plurality of first properties;

receiving the first data from the plurality of measuring devices; and determining a first characteristic of the drilling fluid based on the first data received such that the first characteristic is determined from the plurality of first properties, wherein the first characteristic includes at least one of viscosity, density and sag.

16. The method of claim 15, wherein when the drilling fluid is introduced downhole, the plurality of the measuring devices together detect a plurality of second properties, and wherein the second data relates to the plurality of second properties so as to determine the second characteristic of the drilling fluid.

17. The method of claim 16, wherein the shape of the shell is configured to facilitate the detecting of at least one of the first property and the second property.

* * * * *